US005236341A

United States Patent [19]

Stafford

[11] Patent Number: 5,236,341

[45] Date of Patent: Aug. 17, 1993

[54] AUTOMATIC BLIND RIVET FEEDING SYSTEM ATTACHMENT

[75] Inventor: Donald E. Stafford, Escondido, Calif.

[73] Assignee: Teledyne Ryan Aeronautical, Div. of Teledyne Ind., Inc., San Diego, Calif.

[21] Appl. No.: 848,523

[22] Filed: Mar. 9, 1992

[51] Int. Cl.[5] ..... B65H 3/60

[52] U.S. Cl. ..... 221/200; 29/812.5; 29/243.54; 227/112

[58] Field of Search ..... 221/200; 29/809, 812.5, 29/243, 54, 243, 53; 227/112, 51; 72/453.19, 391, 453.17

[56] References Cited

U.S. PATENT DOCUMENTS

| | | | |
|---|---|---|---|
| 4,005,519 | 2/1977 | Maio et al. | 29/243.54 |
| 4,586,363 | 5/1986 | Dean et al. | 29/812.5 |
| 4,643,344 | 2/1987 | Kaita | 227/112 |
| 4,747,294 | 5/1988 | Schwartz et al. | 29/812.5 |
| 4,754,643 | 7/1988 | Weeks | 72/391 |
| 4,762,261 | 8/1988 | Hawly | 227/66 |

*Primary Examiner*—Robert P. Olszewski
*Assistant Examiner*—Kenneth Noland
*Attorney, Agent, or Firm*—Brown, Martin, Haller & McClain

[57] ABSTRACT

A blind rivet feeding attachment for an automatic riveting machine having a riveting head and a drill mounted on a reciprocating shuttle comprises a rotating transfer arm for picking up a rivet from a supply tube and inserting it in the riveting head of the automatic riveting machine. While the riveting head is drilling a hole in the workpiece at a "work" position, a rivet clamp extracts a new rivet from the supply tube and retains it at the "pickup" position. After the drill has formed the hole, the shuttle moves the riveting head to the work position and installs a rivet in the hole. Rack and pinion gearing rotates the transfer arm towards the rivet clamp in response to the shuttle motion and engages the new rivet tangentially. After the riveting head has installed the rivet, the shuttle moves the riveting head to a "delivery" position, where the transfer arm inserts the new rivet into the riveting head. The gearing rotates the transfer arm back to the pickup position in response to the shuttle motion to pick up the next rivet, which is retained in the rivet clamp. A rivet stem ejector removes the broken-off rivet stem from the head before inserting the new rivet.

15 Claims, 6 Drawing Sheets

AUTOMATIC BLIND RIVET FEEDING SYSTEM ATTACHMENT

BACKGROUND OF THE INVENTION

The present invention relates generally to apparatus for installing blind rivets and, more specifically, to an attachment adapted to automatically feed and install blind rivets when attached to an existing rivet installation machine.

A pull-type blind rivet is a well-known fastener. Although the rivets of various manufacturers may differ in some respects, all pull-type blind rivets comprise a substantially cylindrical stem, an enlarged head portion frangibly connected to one end of the stem, and a shank portion connected to the head. Some rivets additionally have a locking ring anvil collar around the stem in contact with the head.

To join workpieces using such a rivet, the rivet stem is inserted into the chuck or nose of the rivet installation tool, which firmly grasps the rivet stem. The rivet shank is then inserted into a hole through the workpieces and the rivet installation tool, restraining the rivet head against motion relative to the workpieces, applies a pulling force to the stem such that the head engages the head, thereby upsetting it and forming an enlarged mushroom-shaped head on the "blind" side of the workpieces. The stem is then broken off by further pulling and is discarded.

Both portable, hand-held riveting machines and permanently mounted riveting machines suitable for production-line assembly are known. However, because of the complexity of the problems involved in automatically feeding blind rivets from a bulk supply, operators of riveting machines known in the art have been required to manually insert each rivet stem into the nose of the pulling head and to manually eject the broken-off rivet stem from the nose after the riveting operation was complete.

Practitioners in the art have solved some of the problems involved in developing devices for automatically feeding pull-type blind rivets to riveting tools. U.S. Pat. No. 4,604,889 issued to Sukharevsky discloses a hand-held riveting tool with a cam-operated pivoting arm that feeds rivets into the nose portion of the riveting tool. The arm, which is disposed substantially parallel to the direction of pulling force, catches the stem of a rivet pneumatically ejected from a supply tube and pivots to a position such that the rivet stem is aligned with the nose. A hydraulic piston and valve assembly advances the nose to engage the rivet stem, at which point the arm pivots away. After the riveting operation is completed, the broken-off stem is pneumatically drawn into the installation tool and ejected rearward.

U.S. Pat. No. 4,747,294 issued to Schwartz et al. discloses a device for feeding rivets to a rivet installation tool. Unlike Sukharevsky, Schwartz et al. slidably mount a hand-held rivet installation tool on rails that are fixed relative to the workpiece. A rivet transfer arm, which is rotatably mounted perpendicular to the direction of pulling force, slides axially relative to the rails. The transfer arm catches the stem of a rivet pneumatically ejected from a supply tube. It then slides axially away from the feed tube and rotates to a position such that the rivet stem is aligned with the nose. The rivet is ejected from the transfer arm by pneumatic force and is received stem-first by the nose. The transfer arm then rotates away and the tool is advanced along the rails toward the workpiece and the riveting is performed. The broken-off stem is ejected rearwards through the installation tool. Schwartz alternatively discloses advancing and rotating the transfer arm while the installation tool remains fixed.

Neither Sukharevsky nor Schwartz et al. address the problem of fitting an existing rivet installation system with an automatic rivet feeding attachment. Many manufacturers use a general-purpose fastener installation machine that is suited for various fastener types. These machines typically have a reciprocating shuttle on which the fastener tool of choice and a drill mounted are mounted. The shuttle alternately moves the fastener tool and the drill to a position above the workpiece where a fastener can be installed. The shuttle can be positioned with extreme accuracy. The GEMCOR G-400B, produced by the General Drivmatic Co., is an example of such a machine. A blind rivet installation tool such as the Cherry-Textron Model AF704-39 can be mounted on the G-400B fastener installation machine shuttle. However, the lack of a suitable automatic blind rivet feeding system for such systems has forced manufacturers to manually feed rivets to the machine and then manually eject the broken-off stems.

It is not economical for manufacturers already having a blind rivet installation system such as that described above to purchase completely new equipment that is not otherwise as suitable for the sole purpose of acquiring automatic rivet feeding capability. The rivet installation system described above is often more flexible and more suited to manufacturers, needs on production lines than the tools described by Sukharevsky and Schwartz et al.

Furthermore, prior automatic rivet feeding systems have required a separate pneumatic or hydraulic power source apart from that used by the installation tool to supply the rivet pulling force. The need to synchronize the operation of these sources with the operation of the rivet installation tool itself has created the need for complex control systems that involve a large number of sensors.

An automatic blind rivet feeding system that is easily attached to existing fastener installation machines, requires a minimum of external power and control connections, and is easily synchronized with the existing operation of the installation tool would be desirable. These problems and deficiencies are clearly felt in the art and are solved by the present invention in the manner described below.

SUMMARY OF THE INVENTION

The present invention is an automatic blind rivet feeding system attachment for a rivet installation machine. The rivet feeding system may be attached to any existing rivet installation machine having a blind riveting head mounted on a moving shuttle with minimal modification of the existing machine.

To install the rivet feeding system, an actuator arm is clamped or attached by other suitable means to the blind riveting head casing. The riveting head nose, for reference purposes, is said to move downwards and upwards, towards and away from the workpiece, respectively. The actuator arm transmits the motion of the shuttle to a rotating transfer arm, which picks up a rivet and inserts it in the riveting head. Using the existing motion of the shuttle not only eliminates the need for a separate motive source for the transfer arm, but also synchronizes the motion of the transfer arm with the existing operation of the rivet installation machine.

The linear motion of a reciprocating shuttle may be translated to the rotary motion of the transfer arm using relatively simple rack and pinion gearing. In other embodiments, other types of shuttle motion may be translated to the rotary motion of the transfer arm using suitable gearing.

A base or gear case having gearing for translating the motion of the actuator arm to rotary motion is rigidly mounted on the riveting machine itself, i.e., in a stationary position relative to the moving shuttle. The rivet transfer arm rotates in a plane perpendicular to the nose axis. The transfer arm is mounted on a shaft parallel to the nose axis and extending downwardly from the gear case. The shaft and transfer arm are also vertically movable along the shaft axis for inserting the rivet stem into the nose. A rivet inject pneumatic cylinder or other suitable motive means may be used to impart the vertical motion to the shaft and transfer arm.

A rivet feed tube or other suitable supply means such as a vibratory bowl holds a supply of blind rivets. The feed tube may have a vibrator attached for overcoming friction, thereby urging the rivets towards the end of the tube. The end of the tube is at the pickup position where a rivet clamp holds the next rivet for pickup. A rivet clamp pneumatic cylinder or other suitable force-generating means may be used to supply a force for retaining the rivet in the clamp. If a vibrator is included, a sensor may be used to inhibit vibration when a rivet is retained in the clamp.

A DRILL_START command activates the existing rivet installation machine electropneumatics. In response to the DRILL_START signal, a pneumatic cylinder moves the drill downward and drills a hole in the workpiece for the fastener. The rivet feeding system attachment of the present invention is also connected to the electropneumatics and activates the rivet inject pneumatic cylinder in response to the DRILL_START signal. The rivet inject pneumatic cylinder moves the transfer arm, which is positioned directly below the nose, upward to an upper position such that a rivet held by the transfer arm is inserted into the nose. The river inject pneumatic cylinder is then deactivated, returning the transfer arm to a lower position. Although the rivet inject pneumatic cylinder is said to be activated and deactivated, like all pneumatic cylinders of the present invention, it may have bidirectional pneumatic motion, unidirectional pneumatic motion with a spring-loaded return mechanism, or any other control means as known in the art.

Also in response to the DRILL_START signal, the rivet clamp pneumatic cylinder of the present invention applies a force to the rivet clamp, thereby retaining a rivet at the pickup position. When a DRILL_STOP command is initiated, the existing machine electropneumatics move the drill upward and away from the workpiece.

A SHUTTLE_FORWARD command begins moving the rivet installation machine shuttle from the delivery position towards the work position. The drill, being attached to the shuttle, moves away from the work position. In response to the shuttle motion, the transfer arm, through the gearing, rotates from the delivery position to the pickup position, arriving at the pickup position at the same time that the pulling head nose arrives at the work position above the workpiece.

The end of the rivet transfer arm has a slotted pickup made of a suitable resilient material. As the transfer arm rotates to the pickup position, the rivet held in the rivet clamp is tangentially engaged by the pickup slot.

A RIVET_PULL command issued to the existing rivet installation machine activates a solenoid in the existing machine electropneumatics. The pulling head moves downward to the workpiece and installs the rivet as described above. A broken-off rivet stem remains in the head. In the present invention, the rivet clamp pneumatic cylinder is deactivated in response to the RIVET_PULL command, thereby releasing the grip of the rivet clamp on the rivet that is retained in the pickup slot of the transfer arm.

After the fastening operation is complete and the pulling head has moved upward away from the workpiece, a SHUTTLE_RETURN_TO_HOME command may be issued. The shuttle and pulling head begin to move from the work position to the delivery position in response to the SHUTTLE_RETURN_TO_HOME command. In response to this shuttle motion, the transfer arm, through the gearing, rotates from the pickup position to the delivery position, arriving at the delivery position at the same time that the pulling head nose arrives at the delivery position. The transfer arm carries the rivet with it in the pickup. A sensor, in response to the absence of a rivet at the rivet clamp, may activate a vibrator to urge the next rivet towards the clamp.

A rivet stem ejector at the delivery position removes the broken-off rivet stem from the pulling head nose. A pneumatic cylinder urges a portion of the ejector into contact with a collet in the riveting head nose, which releases the stem. The stem may fall into a collection bin for disposal.

At this point, an entire cycle has been completed and the rivet feeding system is in the same state as when the initial DRILL_START command was issued. The transfer arm will move to its upper position in response to a DRILL_START command, inserting the rivet into the pulling head nose. The gripping action of the nose is sufficient to overcome the force with which the rivet is retained in the resilient pickup. The DRILL_START, DRILL_STOP, SHUTTLE_FORWARD, RIVET_PULL, and SHUTTLE_RETURN_TO_HOME commands may be entered manually by an operator or performed in sequence by a computer numerical controller (CNC) or other suitable control means as known in the art. The rivet feeding system is easily attached and synchronized to the existing rivet installation machine regardless of the manner in which the machine is controlled.

The foregoing, together with other features and advantages of the present invention, will become more apparent when referring to the following specification, claims, and accompanying drawings.

BRIEF DESCRIPTION OF THE DRAWINGS

For a more complete understanding of the present invention, I now refer to the following detailed description of the embodiments illustrated in the accompanying drawings, wherein.

DESCRIPTION OF THE PREFERRED EMBODIMENT

Figure 3:
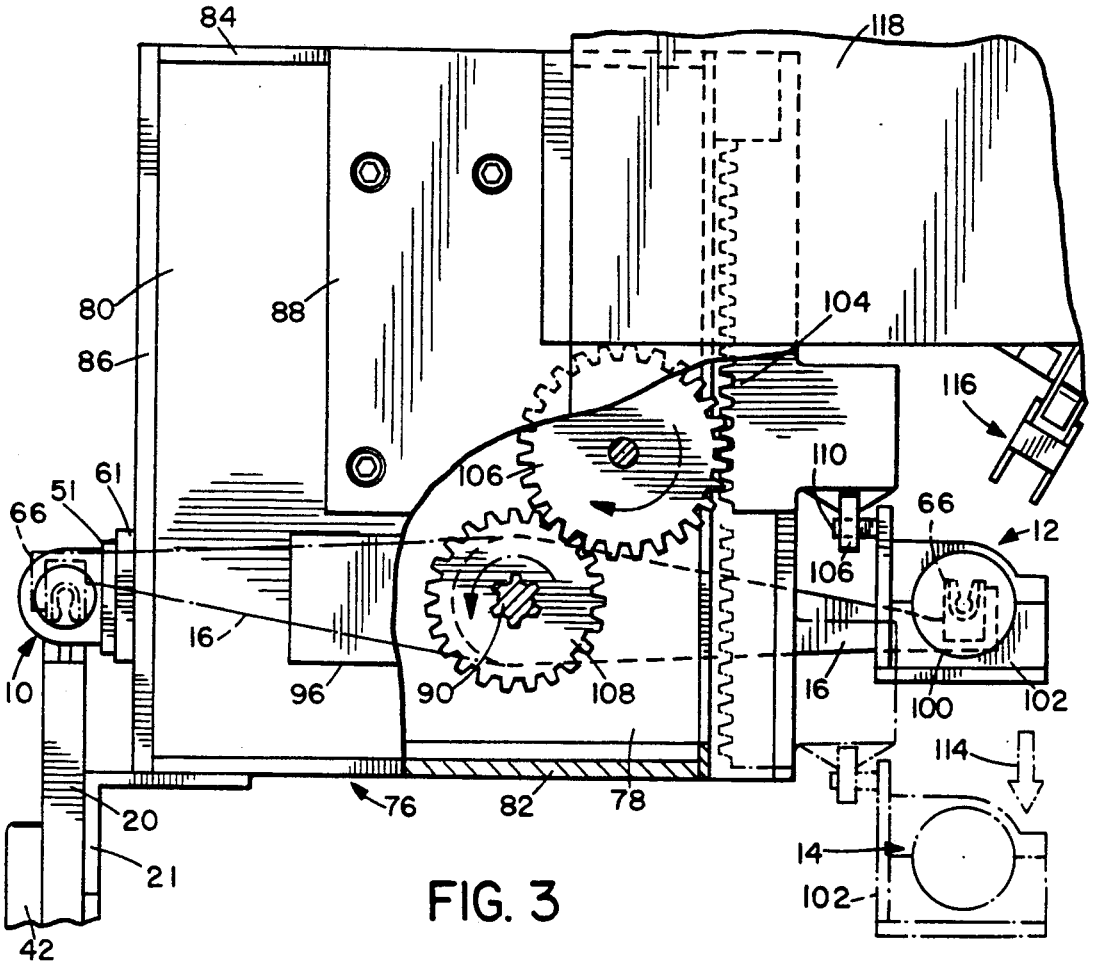
FIG. 3 is a top plan view of the structure of FIG. 2, with a portion cut away.

The spatial relationship among the pickup position 10, the delivery position 12, and t he work position 14, is shown in FIG. 3. The sequence of functions of the present invention is described with reference to these positions.

Figure 1:
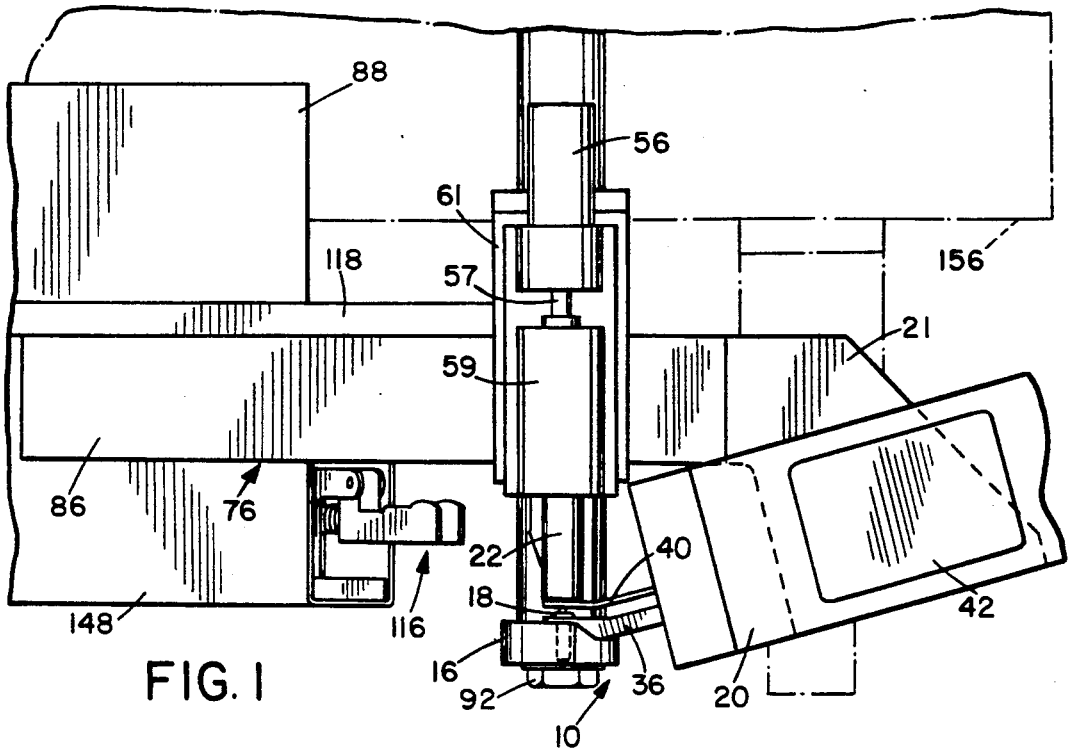
FIG. 1 is a side elevational view of a portion of the riveting machine, showing the rivet pickup position.
Figure 7:
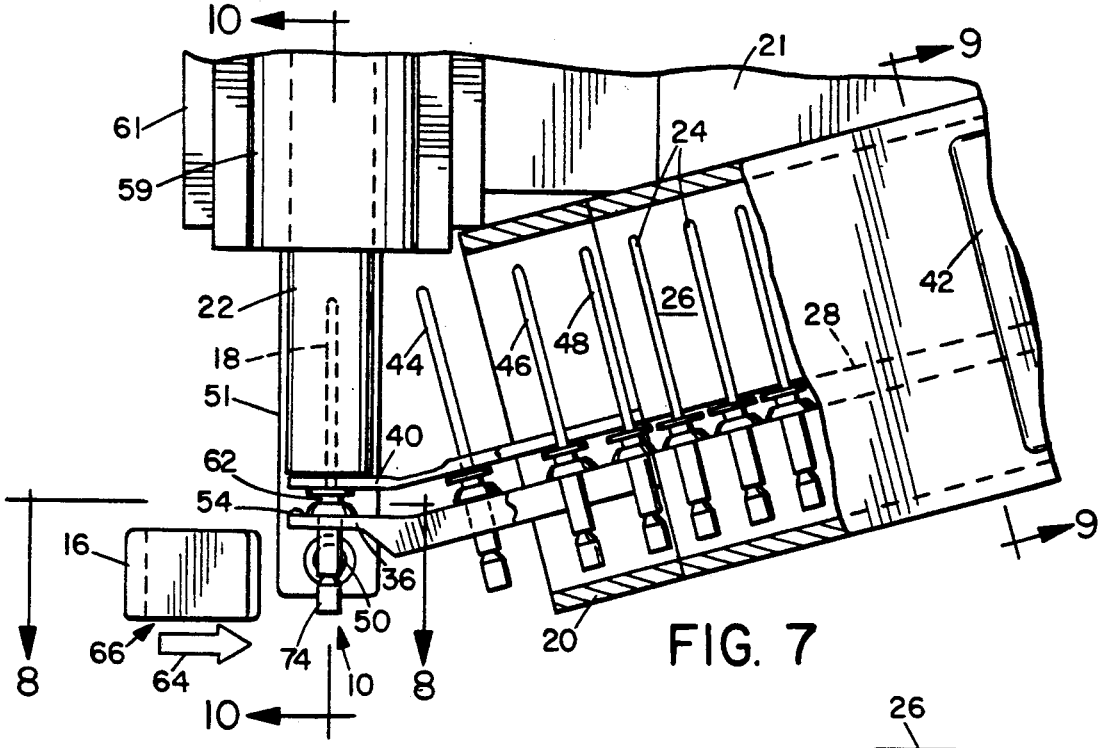
FIG. 7 is an enlarged side elevational view, partially cut away, of the rivet feed and pick-up station.
Figure 8:
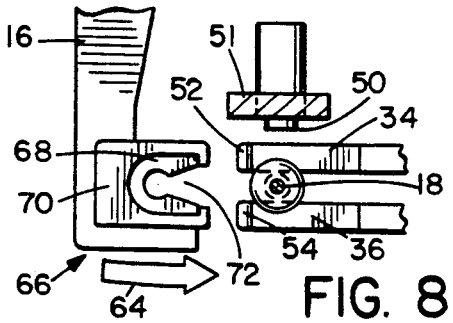
FIG. 8 is a sectional view taken along line 8—8 of FIG. 7.
Figure 9:
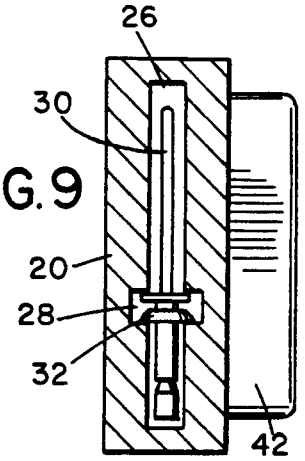
FIG. 9 is a sectional view taken along line 9—9 of FIG. 7.
Figure 10:
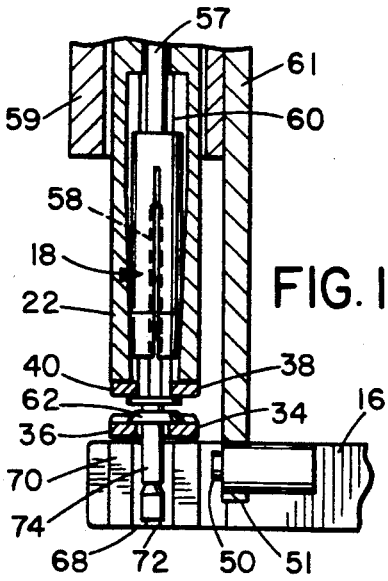
FIG. 10 is a sectional view taken along line 10—10 of FIG. 7.

In FIG. 1, the rivet transfer arm 16 receives a blind rivet 18 from the rivet feed tube 20 at pickup position 10, directly beneath the rivet clamp 22. Feed tube 20 is connected to the remainder of the invention with a feed tube bracket 21. This rivet feeding action is described in detail with reference to FIGS. 7-11. In FIG. 7, rivet feed tube 20 holds a supply of blind rivets 24 in a channel 26. As shown in FIG. 9, a head groove 28 in channel 26 supports a rivet 30 by its head 32. Gravity urges rivets 24 down feed tube 20 towards pickup position 10. Rivet support fingers 34 and 36 extend outward from feed tube 20 below head groove 28 towards pickup position 10. Rivet clamp fingers 38 and 40 extend outward from feed tube 20 above head groove 28 towards pickup position 10. A vibrator 42, attached to feed tube 20 overcomes the frictional forces between rivets 24 and feed tube 20, thereby facilitating their movement towards pickup position 10. Upon reaching the end of channel 26, rivets 44, 46, and 48 are guided towards pickup position 10 between rivet support fingers 34 and 36 and rivet clamp fingers 38 and 40, respectively.

In FIG. 7, rivet 18, aided by the action of vibrator 42, has reached pickup position 10 and is clamped by rivet clamp 22. A sensor 50, which is mounted on a sensor support 51, detects the presence of rivet 18 at pickup position 10 and deactivates vibrator 42. Sensor 50 may be of any suitable type such as optical, inductive, magnetic, or Hall-effect. The stem 58 of rivet 18 enters a clamp slot 60 in the bottom of rivet clamp 22. Ridges 52 and 54 on the ends of support fingers 34 and 36 respectively, prevent rivet 18 from moving beyond pickup position 10 and precisely position it beneath rivet clamp 22.

A rivet clamp pneumatic cylinder 56 is then activated, extending a rivet clamp plunger 57 downward. Rivet clamp plunger 57 urges rivet clamp 22, which is guided by rivet clamp housing 59, downward over stem 58 of rivet 18. Rivet clamp housing 59 is attached to the remainder of the invention with rivet clamp mounting bracket 61. As rivet clamp 22 moves downward it contacts rivet clamp fingers 38 and 40. The downward force on rivet clamp fingers 38 and 40 flexes them into contact with head 62 of rivet 18, pressing it against support fingers 34 and 36, thereby clamping rivet 18.

With rivet 18 securely held between rivet clamp fingers 38 and 40 and rivet support fingers 34 and 36 respectively, the distal end of transfer arm 16 moves in the direction of arrow 64 to engage rivet 18. The distal end of transfer arm 16 has a pickup assembly 66 comprising a resilient cast pickup 68 mounted in a pickup casing 70. Pickup 68 may be mounted with a suitable adhesive or other fastening means. Pickup 68 has a pickup slot 72 into which it tangentially engages the shank 74 of rivet 18. After rivet 18 has been received in pickup 68, rivet clamp pneumatic cylinder 56 is deactivated, retracting rivet clamp plunger 57 upwards. The upward movement of rivet clamp plunger 57 urges rivet clamp 22 upwards, releasing rivet 18. Shank 74 of rivet 18 is resiliently retained in pickup 68.

Figure 11:
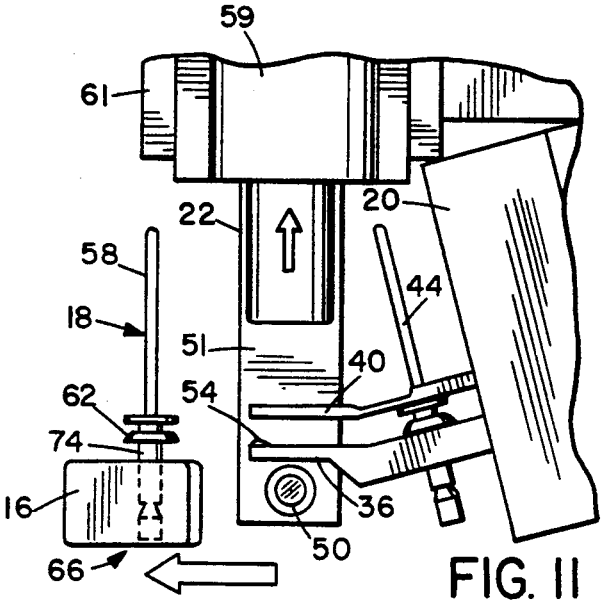
FIG. 11 is a view similar to FIG. 7, showing a rivet held by the delivery arm.

When rivet transfer arm 16 moves away from pickup position 10 as shown in FIG. 11, stem 58 of rivet 18 may exit rivet clamp 22 through slot 60. Sensor 50 no longer detects the presence of rivet 18. In response to the absence of a rivet detection, vibrator 42 is activated. The vibration urges rivet 44 towards pickup position 10 because rivet clamp 22 has been retracted, allowing rivet 44 to move freely. Similarly, the vibration urges rivets 46, 48, and 24 towards pickup position 10. Sensor 50 detects the presence of rivet 44 when it reaches pickup position 10 and deactivates vibrator 42. Rivet clamp pneumatic cylinder 56 is the activated, clamping rivet 44 in rivet clamp 22 as described above with respect to rivet 18.

Figure 2:
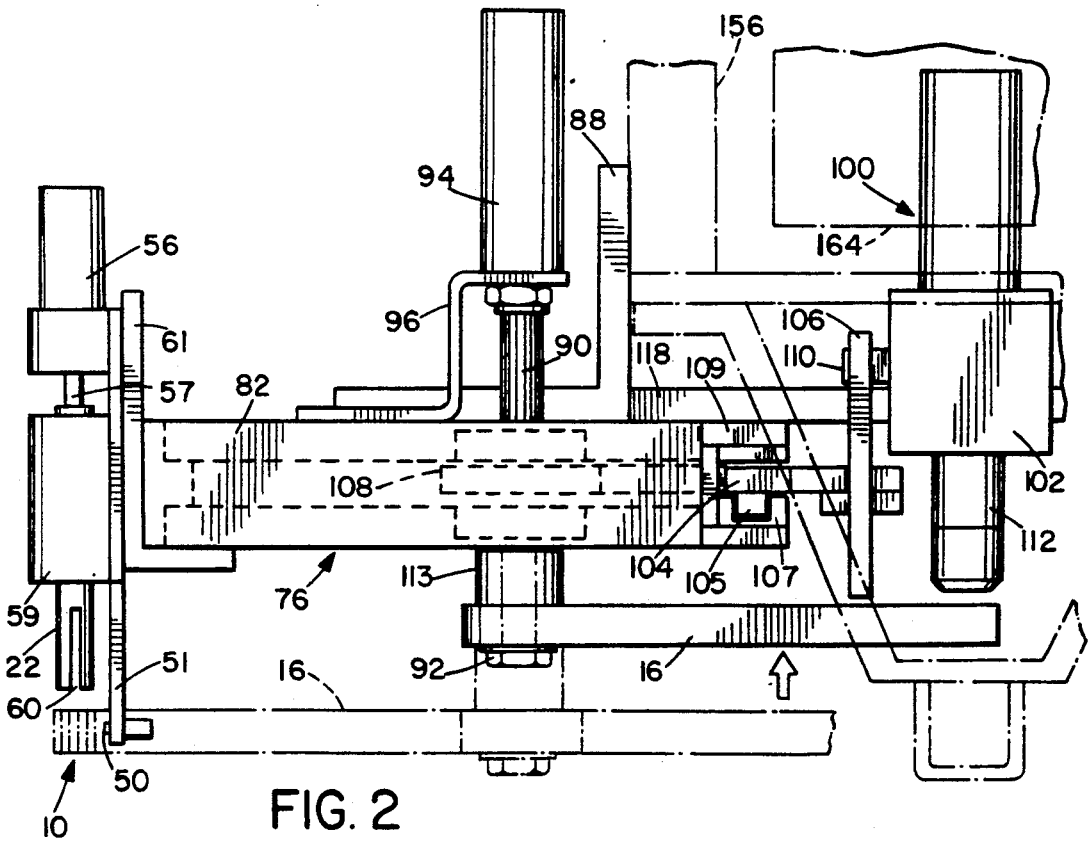
FIG. 2 is a front view as taken from the right hand side of FIG. 1.

In FIGS. 2-3, a gear case 76 comprises a gear case bottom 78, a gear case top 80, two gear case sides 82 and 84, and a gear case back 86. Mounting bracket 88 connects gear case 76 to a convenient site on the rivet installation machine, which is shown in phantom lines. A spline shaft 90 extends vertically through gear case 76. A transfer arm retainer 92 connects the proximal end of transfer arm 16 to the lower end of spline shaft 90. The upper end of spline shaft 90 is connected to the rivet inject pneumatic cylinder 94, which can move transfer arm 16 axially through gear case 76. Rivet inject pneumatic cylinder 94 is mounted on gear case top 80 with rivet inject cylinder mounting bracket 96.

Riveting head 100 is mounted on the shuttle 164 (FIG. 15) of the rivet installation machine 156 (FIG. 15) shown in phantom lines in FIG. 2. In FIG. 3, an actuator arm 102, clamped around riveting head 100, transmits the horizontal linear motion of shuttle 164 to a drive rack 104. Drive rack 104 has a rack keeper 105, which slides in a rack way 107 and below a rack slide 109. Drive rack 104 contacts and rotates idler gear 106, which in turn contacts and rotates drive gear 108. Drive gear 108 rotates spline shaft 90, which slidably extends through a mating opening in the center of drive gear 108.

Drive rack 104 has a vertical portion 106, which has a drive pin slot 108 extending along its length. A drive pin 110 on actuator arm 102 extends through drive pin slot 108 to allow riveting head 100 to move vertically relative to drive rack 104.

After transfer arm 16 has received rivet 18 as described above, shuttle 164 returns actuator arm 102 from work position 14 to delivery position 12, shown in full line in FIG. 3. In response to this motion, the gearing described above rotates transfer arm 16 180° from pickup position 10 to delivery position 12, directly below riveting head 100.

Figure 4:
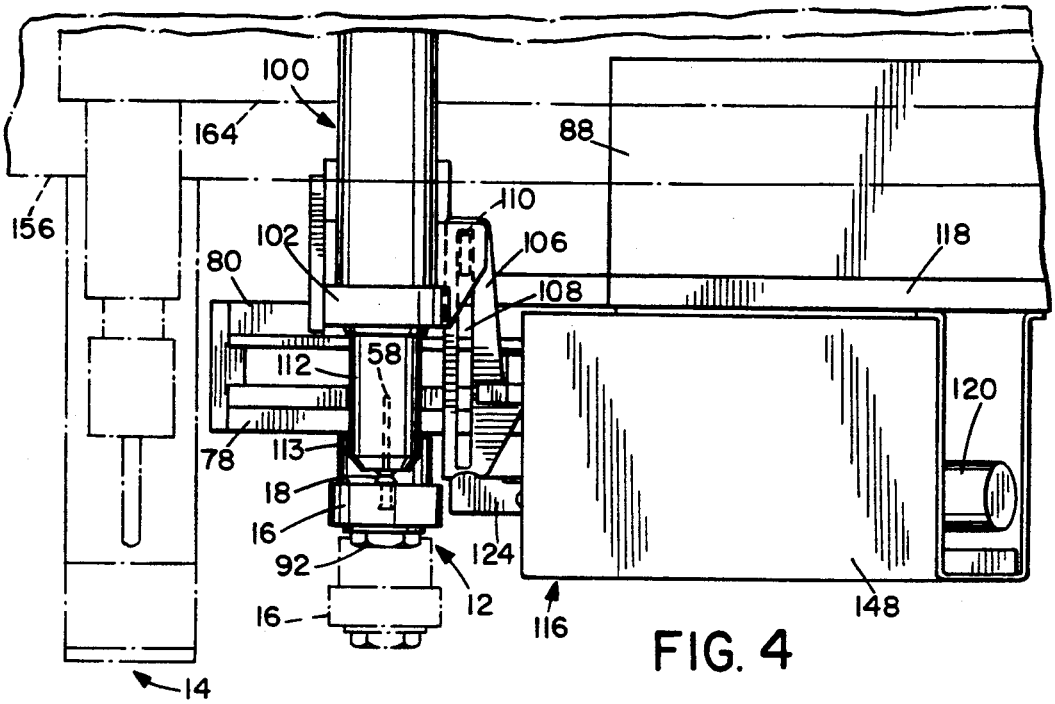
FIG. 4 is a side elevational view as taken from the right hand side of FIG. 2.

In FIG. 4, rivet inject cylinder 94 is activated, retracting spline shaft 90 and raising transfer arm 16 to the position shown in full line, thereby inserting rivet stem 468 into the riveting head nose 112. A resilient spacer 113 checks the upward movement of transfer arm 16 and cushions the impact. A collet (not shown) in the riveting head nose 112 frictionally engages rivet stem 468 and retains it in riveting head nose 112. Rivet inject cylinder 94 is then deactivated, extending spline shaft 90 and lowering transfer arm 16 to the position shown in phantom line.

Figure 5:
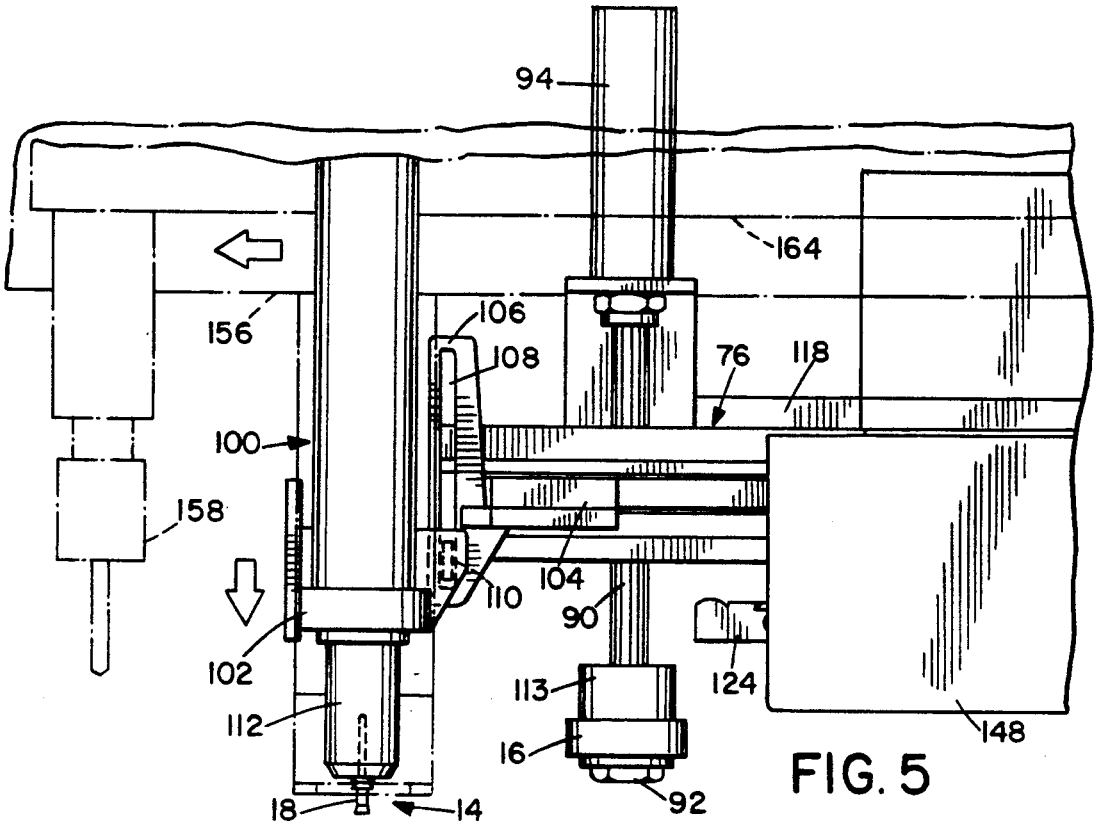
FIG. 5 is a side view similar to FIG. 4, with the riveting head at the work position.
Figure 6:
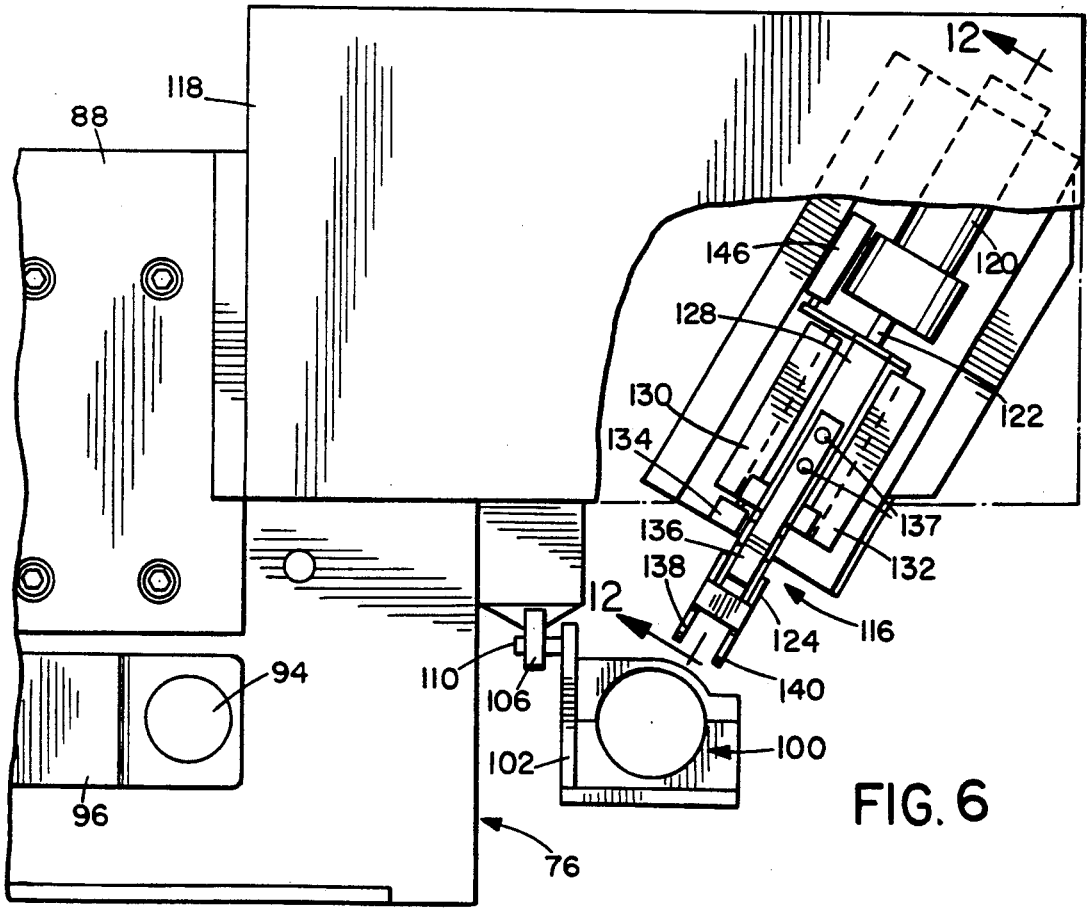
FIG. 6 is a top plan view similar to FIG. 3, showing the rivet stem ejector mechanism.

In FIG. 3, shuttle 164 moves actuator arm 102 in the direction of arrow 114 from delivery position 12 to work position 14. In response to this motion, the gearing described above rotates transfer arm 16 to engage rivet 44 at pickup position 10, as described above with respect to rivet 18. Rivet clamp 22 releases rivet 44, which is retained in pickup 68. As shown in FIG. 5, automatic rivet installation machine 156 may activate riveting head 100, lowering it and installing rivet 18 in a workpiece (not shown). As riveting head 100 is lowered, drive pin 110 of actuator arm 102 slides downward in drive pin slot 108. After installing rivet 18, automatic rivet installation machine 156 raises riveting head 100. It then moves shuttle 164 to return riveting head 100 to delivery position 12, as shown in FIG. 6.

Before riveting head nose 112 may receive rivet 44 at delivery position 12, the broken stem of rivet 18, which remains in riveting head nose 112 as a result of the installation of rivet 18, must be released. Although the broken stem may be removed at any location between work position 14 and delivery position 12, in the preferred embodiment rivet stem ejector 116 is activated after riveting head 100 reaches delivery position 12. Rivet stem ejector 116 is mounted on a support plate 118, which is attached to gear case top 80.

Figure 12:
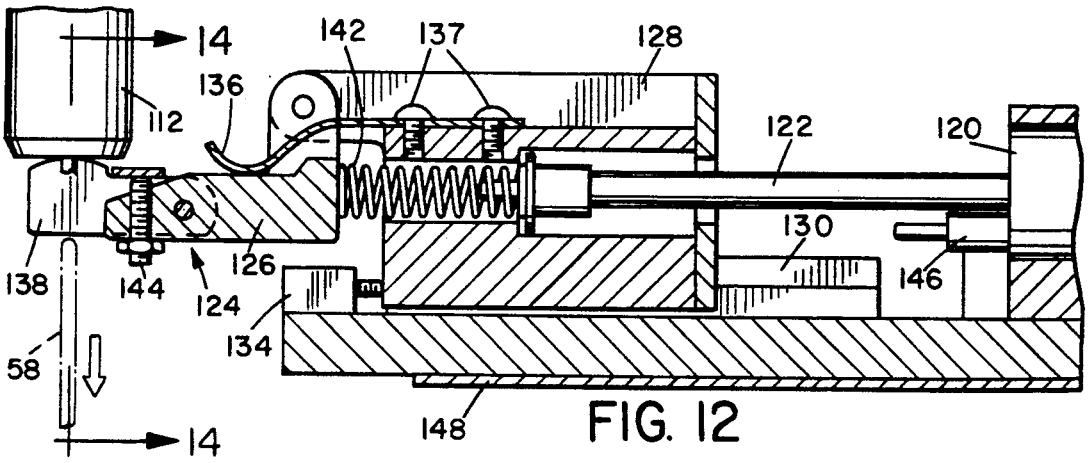
FIG. 12 is an enlarged sectional view taken along line 12—12 of FIG. 6, with the rivet stem ejector in an extended position for releasing a rivet stem.
Figure 13:
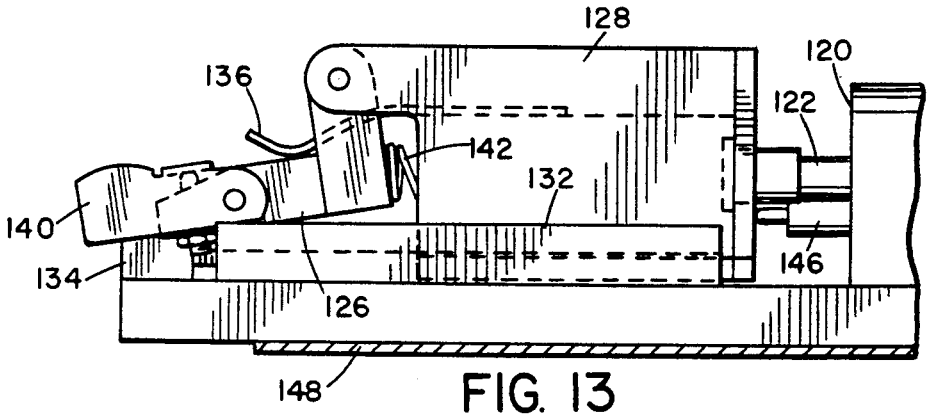
FIG. 13 is a side elevational view of the structure of FIG. 12, with the rivet stem ejector in a retracted position.
Figure 14:
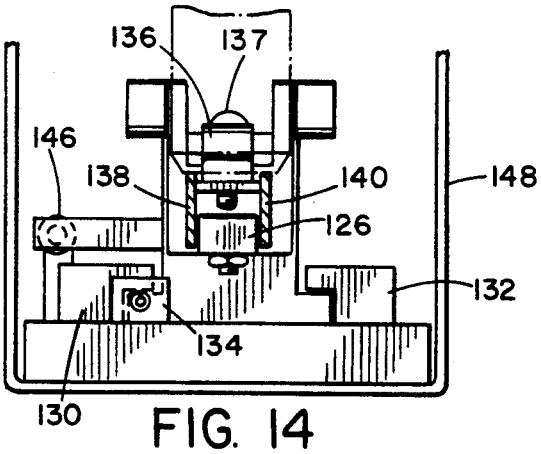
FIG. 14 is a sectional view taken along line 14—14 of FIG. 12.

In FIGS. 12–14, when rivet stem ejector 116 is activated, a rivet stem ejector pneumatic cylinder 120 extends a plunger 122 outwards towards riveting head nose 112. Plunger 122 in turn urges an ejector pawl 124 towards riveting head nose 112. Ejector pawl 124 has an L-shaped portion 126 that is hingedly connected to an ejector carriage 128. Ejector carriage 128 slides towards and away from riveting head nose 112 on ejector rails 130 and 132. A forward carriage stop 134 checks the movement of ejector carriage 128 towards riveting head nose 112. When ejector carriage 128 contacts forward carriage stop 134, the force applied by plunger 122 to L-shaped portion 126 of ejector pawl 124 overcomes a leaf spring 136, and swings ejector pawl 124 upwards towards the bottom of riveting head nose 112. Leaf spring 136 is attached to carriage 128 with fasteners 137. Two ejector fingers 138 and 140, which are connected to L-shaped portion 126 of ejector pawl 124, contact the collet (not shown) in riveting head nose 112, thereby releasing the broken stem, shown in phantom lines in FIG. 12. A plunger spring 142 provides resilient contact between plunger 122 and L-shaped portion 126 to cushion the impact of ejector fingers 138 and 140 on the collet. An adjustment screw 144 provides adjustment of the height of ejector fingers 138 and 140 relative to the collet when plunger 122 is fully extended.

After releasing the broken rivet stem, rivet stem ejector 116 is deactivated. Rivet stem ejector pneumatic cylinder 120 retracts plunger 122. As plunger 122 is retracted, leaf spring 136 urges ejector pawl 124 downwards and away from riveting head nose 112. As plunger 122 is further retracted, it moves ejector carriage 128 inwards and away from riveting head nose 112. A rear carriage stop 146 stops the rearward movement of ejector carriage 128 and may comprise a limit switch for preventing activation of riveting head 100 when ejector carriage 128 is in an extended position. An ejector guard 148 around rivet stem ejector 116 shields the mechanism to minimize the intrusion of foreign matter such as drilling chips and to increase operator safety.

Figure 15:
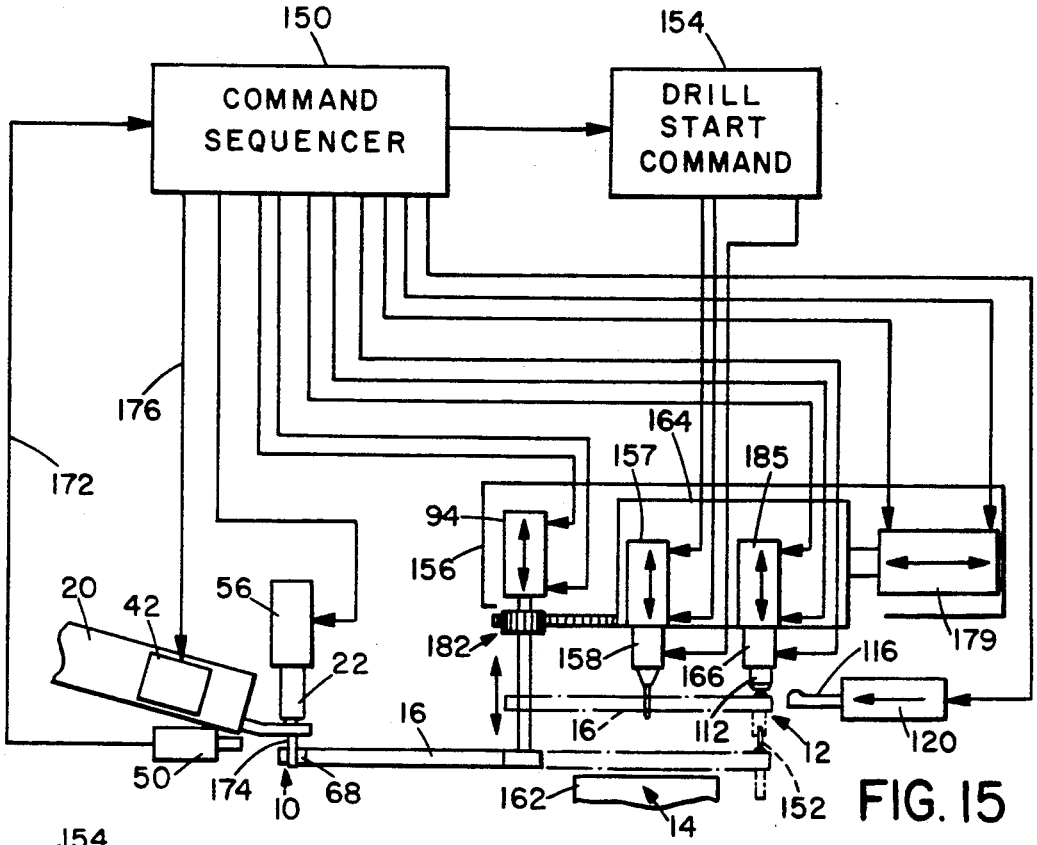
FIG. 15 is a diagram of the basic actuating system of the riveting machine.
Figure 16:
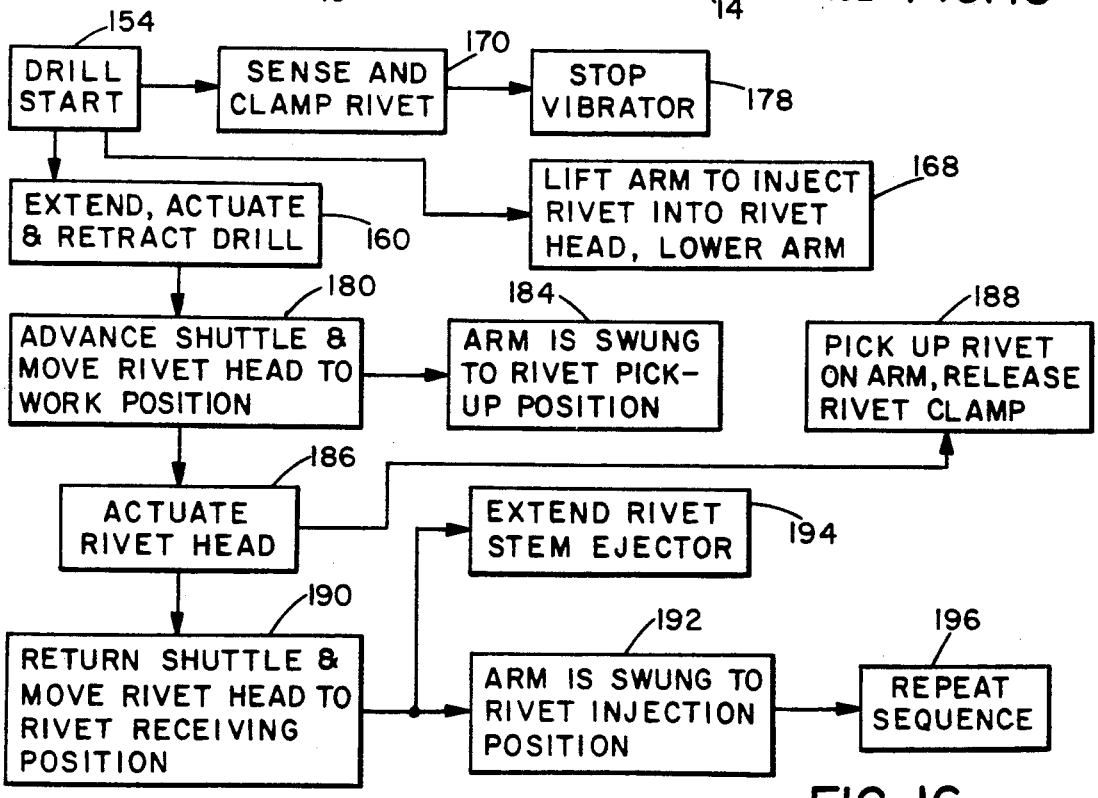
FIG. 16 is a flow diagram of the sequence of functions.

The functions described above may be repeatedly performed in sequence with minimal modification to the control programming of existing automatic rivet installation machine 156. In FIGS. 15 and 16, a command sequencer 150 responds to preexisting commands of the automatic rivet installation machine 156. Such commands may include DRILL_START, DRILL_STOP, SHUTTLE_FORWARD, RIVET_PULL, and SHUTTLE_RETURN_TO_HOME. Command sequencer 150 may comprise solenoids (not shown) that are activated by signals corresponding to the commands. The solenoids control the pneumatic pressure to rivet clamp pneumatic cylinder 56, rivet inject pneumatic cylinder 94, and stem ejector pneumatic cylinder 120.

Although the sequence may be begun in any of the states described above, for purposes of illustration it is described herein beginning in the state shown in full line in FIG. 3. Before activating automatic rivet installation machine 156 and the rivet feeding attachment of the present invention, an operator should manually insert an initial rivet 152 in pickup 68 of transfer arm 16 and align rivet 152 beneath riveting head nose 112. Rivet feed tube 20 should be loaded before proceeding.

First, a DRILL_START command 154 is issued. The existing automatic riveting machine 156 activates drill electropneumatics 157, which lowers drill 158 and drills a rivet hole (not shown) in workpiece 162 at step 160. Drill 158 is mounted on shuttle 164 adjacent to the riveting head 166. In the initial state, drill 158 is at work position 14 and riveting head 166 is at delivery position 12. In response to the DRILL_START command, command sequencer 150 activates rivet inject pneumatic cylinder 94, raising transfer arm 16 to insert rivet 152 in riveting head nose 112 at step 168. Command sequencer 150 then deactivates rivet inject pneumatic cylinder 94, lowering transfer arm 16. Command sequencer 150 also activates rivet clamp pneumatic cylinder 56 in response to the DRILL_START command at step 170.

At step 178, command sequencer 150 provides a signal 176 for deactivating vibrator 42 in response to a signal 172 from sensor 50, which indicates the presence of rivet 174. When a DRILL_STOP command is issued, automatic riveting machine 156 retracts drill 158 and deactivates it.

Next, a SHUTTLE_FORWARD command is issued. Automatic riveting machine 156 activates shuttle electropneumatics 179 to move shuttle 164. The shuttle locates riveting head 166 at work position 14 at step 180. In response to the motion of shuttle 164, gearing 182 rotates transfer arm 16 to engage rivet 174 in pickup 68 at step 184.

Then, a RIVET_PULL command is issued. Automatic riveting machine 156 activates riveting head electropneumatics 185, which lowers riveting head 166 and installs rivet 152 in workpiece 162 at step 186. At step 188, command sequencer 150 deactivates rivet clamp pneumatic cylinder 56 in response to the RIVET_PULL command, releasing rivet 174 from rivet clamp 56. Rivet 174 is retained in pickup 68 of transfer arm 16.

Finally, a SHUTTLE_RETURN_TO_HOME command is issued. Automatic riveting machine 156 moves shuttle 164 to locate riveting head 166 at delivery position 12 at step 190. In response to the motion of shuttle 164, gearing 182 rotates pickup 68 of transfer arm 16 to delivery position 14 at step 192. In response to the SHUTTLE_RETURN_TO_HOME command, command sequencer 150 activates rivet stem ejector 120 at step 194. In this state, the sequence may be repeated upon issuance of another DRILL_START command at step 196.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A blind rivet feeding apparatus for engaging a rivet at a pickup position, inserting said rivet into a riveting machine nose at a delivery position, and removing a rivet stem from said nose, said riveting machine nose moving between said delivery position and a work position, said blind rivet feeding apparatus comprising:

a base fixedly mounted with respect to said work position;

shaft means having an axis normal to said base, said shaft means axially movable with respect to said base and rotatable about said axis with respect to said base;

rivet supply means for retaining a plurality of rivets and for providing a rivet of said plurality at said pickup position;

transfer arm means having a proximal end connected to said shaft means, and a distal end for frictionally retaining said rivet;

drive means for rotating said shaft means in response to said motion of said riveting machine nose;

injection means for moving said shaft means axially with respect to said base; and rivet stem ejector means for removing a rivet stem from said riveting machine nose.

2. A blind rivet feeding apparatus as described in claim 1 wherein:

said distal end of said transfer arm means is at said pickup position when said riveting machine nose is at said work position; and said distal end of said transfer arm means is at said delivery position when said riveting machine nose is at said delivery position.

3. A blind rivet feeding apparatus as described in claim 2, wherein said pickup position, said delivery position, and a point corresponding to said axis of said shaft means are collinear.

4. A blind rivet feeding apparatus as described in claim 3, wherein said distal end of said transfer arm means comprises a resilient pickup for frictionally engaging said rivet.

5. A blind rivet feeding apparatus as described in claim 4, wherein said resilient pickup has a slot tangent to the direction of said rotation of said shaft means for tangentially engaging said rivet.

6. A blind rivet feeding apparatus as described in claim 5, wherein said drive means comprises:

a rack connected in rigid relation to said riveting machine nose; and gear means for engaging said rack and for rotating said shaft means.

7. A blind rivet feeding apparatus as described in claim 6, wherein:

said shaft means comprises a splined shaft; and said gear means comprises a drive gear having an opening for slidably engaging said splined shaft.

8. A blind rivet feeding apparatus as described in claim 7, wherein said injection means comprises a pneumatic cylinder connected in rigid relation to said splined shaft.

9. A blind rivet feeding apparatus as described in claim 8, said gear means further comprising an idler gear between said drive gear and said rack.

10. A blind rivet feeding apparatus as described in claim 2, wherein said rivet supply means comprises:

a rivet feed tube for holding a plurality of rivets, said tube having an exit end for providing a rivet of said plurality; and clamp means disposed at said exit end for selectably retaining said provided rivet at said exit end.

11. A blind rivet feeding apparatus as described in claim 10, said clamp means further comprising:

clamping force means for providing a clamping force;

rivet support finger means for supporting a portion of said provided rivet, said rivet support finger means connected in rigid relation to said rivet feed tube; and rivet clamp finger means for resiliently urging said portion of said rivet against said support finger means in response to said clamping force.

12. A blind rivet feeding apparatus as described in claim 11, wherein said clamping force means comprises a pneumatic cylinder.

13. A blind rivet feeding apparatus as described in claim 12, said rivet supply means further comprising:

a vibrator for inducing motion of a rivet of said plurality toward said exit end of said feed tube.

14. A blind rivet feeding apparatus as described in claim 2, wherein said rivet stem ejector means comprises:

ejector force means for providing an ejector force; and a plunger having a first end connected to said ejector force means and a second end; and an ejector pawl connected to said second end of said plunger for contacting a portion of said riveting machine nose in response to said ejector force.

15. A blind rivet feeding apparatus as described in claim 14, wherein said ejector pawl is connected in hinged relation to said plunger.

* * * * *